United States Patent [19]

Joy et al.

[11] Patent Number: 4,700,014

[45] Date of Patent: Oct. 13, 1987

[54] CAP FOR INSULATOR SUPPORT HOUSING

[75] Inventors: Ira L. Joy, Alabaster; Arunas A. Arstikaitis, Helena; James R. Troulias, Birmingham, all of Ala.

[73] Assignee: Combustion Engineering, Inc., Windsor, Conn.

[21] Appl. No.: 20,848

[22] Filed: Mar. 2, 1987

[51] Int. Cl.[4] ..... H01B 17/26; B03C 3/86

[52] U.S. Cl. ..... 174/31 R; 55/120; 55/146; 55/148

[58] Field of Search ..... 174/14 BH, 15 BH, 16 BH, 174/31 R, 31.5, 139, 211; 55/146, 148, 120; 220/254

[56] References Cited

U.S. PATENT DOCUMENTS

| | | | |
|---|---|---|---|
| 1,856,125 | 5/1932 | Austin | 174/15 BH |
| 1,994,259 | 3/1935 | Thorne | 174/16 BH X |
| 2,720,551 | 10/1955 | Wastvind et al. | 174/31 R |
| 4,294,591 | 10/1981 | Kahl | 174/211 X |

FOREIGN PATENT DOCUMENTS

| | | | |
|---|---|---|---|
| 119 | of 1913 | United Kingdom | 174/31 R |

*Primary Examiner*—Kathleen J. Prunner
*Attorney, Agent, or Firm*—William W. Habelt

[57] ABSTRACT

A cover cap (40) is provided for covering the open end of a support insulator (38) having a discharge electrode hanger rod (28) passing coaxially therethrough. The cover cap (40) comprises a top (42) and a sloping side wall (44) extending coaxially outwardly and downwardly from the perimeter edge (54) of the top (42) and having a radial lip (46) and an axial lip (48) extending outwardly at substantially right angles to each other from its lower perimeter surface. A tubular gas injection nozzle (92) having an elbow subtending an angle of 135 degrees, is provided in the sloping side wall (44) for passing a jet of scavenging gas into the interior region encompassed by the sloping side wall (44). At least one access opening (70) is provided in the sloping side wall for permitting access into the interior region encompassed by the sloping side wall (44). Lid (72) is provided for covering the access opening (70) in the sloping side wall to seal the opening when the lid is not removed to permit access into the interior region encompassed by the sloping side wall.

1 Claim, 3 Drawing Figures

CAP FOR INSULATOR SUPPORT HOUSING

BACKGROUND OF THE INVENTION

The present invention relates to insulator supports for electrically insulating an axially extending support rod carrying an electrical charge from a grounded housing surrounding the support rod and, more particularly, to an improved cap structure for such a housing which facilitates maintainance of the interior of the housing in a clean condition free of excessive dust accumulation. The invention has particular applicability to insulators used for supporting the discharge electrode hanger rods from the grounded housing of an electrostatic precipitator.

In the operation of an electrostatic precipitator, a gas laden with entrained particulate material is passed through an electrostatic field established about a discharge electrode disposed between two grounded collecting electrodes. The suspended particles become electrically charged as they pass through the electrostatic field and move under the influence of the electrostatic field to and deposit upon the electrically grounded collecting electrodes flanking each discharge electrode. Each collecting electrode is typically formed of one or more elongated plates disposed and suspended from the top of the precipitator housing in a vertical plane. A plurality of such collecting electrodes are disposed transversely across the precipitator casing in spaced vertical planes parallel to the direction of gas flow through the precipitator.

In the most common electrostatic precipitators, referred to as rigid frame electrostatic precipitators, a boxlike framework comprised of a plurality of discharge electrode frames mounted in a framework which is suspended by hanger rods from support insulators at the top of the electrically grounded precipitator housing to provide a row of vertically disposed discharge electrodes between adjacent collecting electrodes across the width of the precipitator. The voltage is applied to the discharge electrodes to generate the electrostatic field. Each discharge electrode frame is comprised of a plurality of individual flexible discharge electrode members, commonly comprising wires tautly strung across the support frame or tubes extending between frame members.

Since the hanger rods supporting the discharge electrode mounted to the framework are mounted to the grounded precipitator housing and since the hanger rods are typically electrically conductive, each hanger rod supporting the electrically charged discharge electrode framework is insulated from the grounded precipitator housing by an electrically non-conductive canlike insulator disposed coaxially about an opening in the precipitator housing through which the hanger rod extends coaxially through the top of the insulator housing from which it is supported in electrical isolation from the grounded precipitator housing.

Since the insulator housing remains in fluid communication with the interior of the precipitation chamber, particulate matter may settle in the insulator housing and accumulate sufficiently to bridge the annular space from the hanger rod to the interior surface of the region of the precipitator housing surrounding the opening through which the hanger rod passes, thereby establishing a conductive path along which electrical arcing may occur. One common method applied to attempt to limit such adverse dust accumulation within the insulator housing is to provide a flow of higher pressure cleaning gas, such as an inert gas, air or heated air, into the interior of the insulator housing to flow outwardly therefrom into the precipitation chamber thereby preventing particulate entrained gas from entering the insulator housing to deposit particulate matter therein, as well as providing a continuous purging airflow to carry particulate matter that may have been deposited in the insulator housing into the precipitator housing. Examples of such a design are disclosed in U.S. Pat. Nos. 3,531,918, 4,294,591; and 4,578,088. The scavenging airflow introduced into the insulator may be heated as disclosed to U.S. Pat. No. 4,294,591 to exceed the dewpoint temperature of gas in the precipitator thereby preventing condensation of water vapor or acidic vapors within the insulator housing.

SUMMARY OF THE INVENTION

A cover cap is provided for covering an open end of a housing, such as a support insulator, having a rod-like member, such as a discharge electrode hanger rod passing coaxially therethrough. The cover cap comprises a top plate and a sloping side wall extending coaxially outwardly and downwardly from the perimeter edge of the top plate having a radial lip and an axial lip extending outwardly at substantially right angles to each other from its lower perimeter surface. A centrally located hole is provided in the top plate to receive the rod-like member. The axial lip is adapted to insert in closely spaced relationship into the open end of the housing, while the radial lip is adapted to abut and close against the rim surface of the open end of the housing.

Gas injection means, preferrably in the form of a tubular member having an elbow subtending an angleof 135 degrees, is provided in the sloping side wall for passing a jet of scavenging gas into the interior region encompassed by the sloping side wall. At last one access opening is provided in the sloping side wall for permitting access into the interior region encompassed by the sloping side wall. Lid means are provided for covering the access opening in the sloping side wall to seal the opening when the lid means is not removed to permit access into the interior region encompassed by the sloping side wall.

DESCRIPTION OF THE PREFERRED EMBODIMENT

Figure 1:
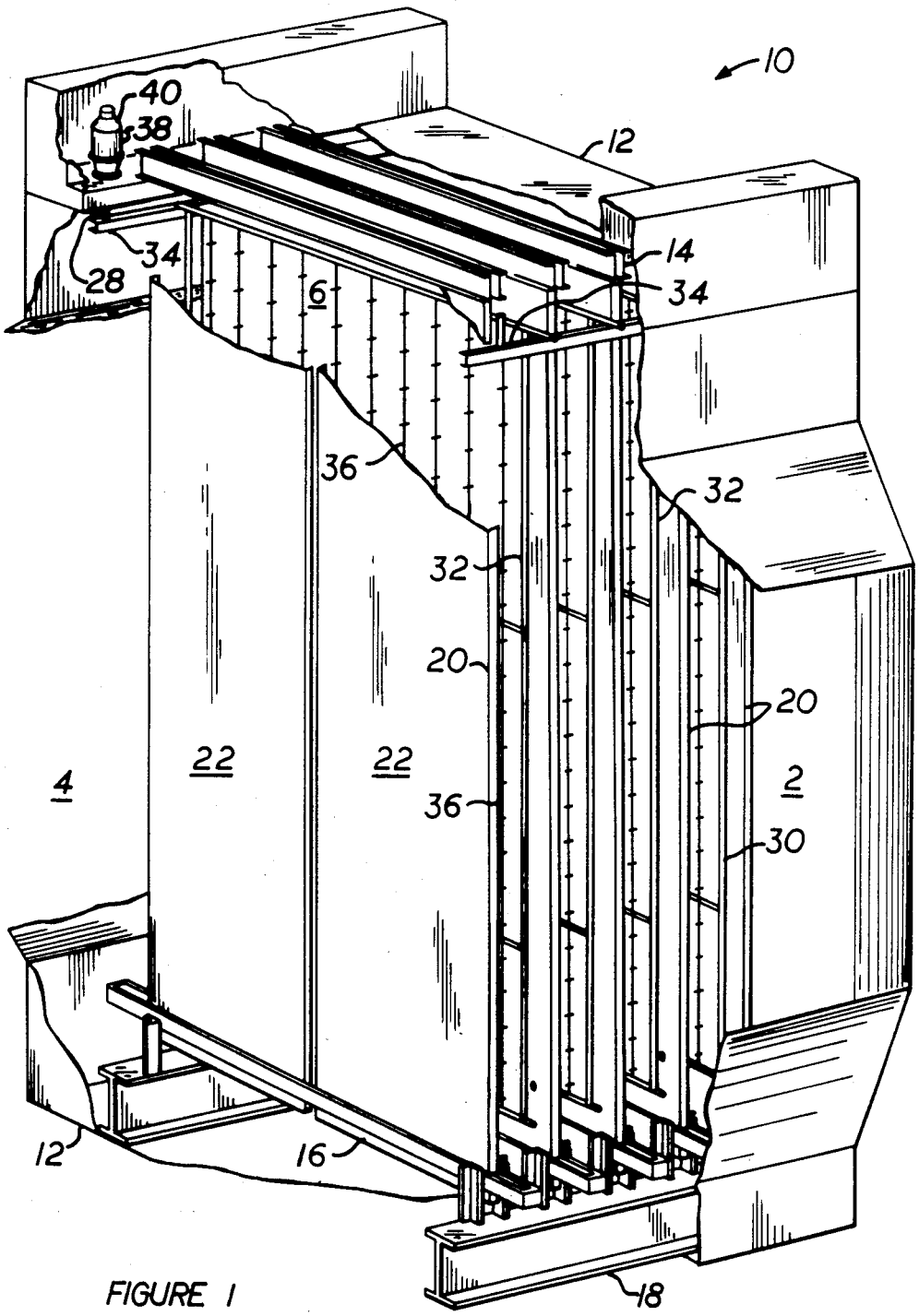
FIG. 1 is a perspective view, partly in section, of a typical electrostatic precipitator.

Referring now to the FIG. 1 drawing, there is depicted therein an electrostatic precipitator 10 having a casing 12 with an inlet 2 and an outlet 4 and a precipitation chamber 6 disposed therebetween. The particulate laden flue gas to be cleaned passes through the housing 12 of the precipitation chamber 6 and out the gas outlet 4 as a clean, relatively particulate free gas.

The basic configuration of the precipitator 10 is well known in the art, and is typically referred to as a rigid discharge electrode type electrostatic precipitator. A plurality of substantially rectangular collecting electrode plates 22, forming collectively a collecting electrode plate assembly 20, are disposed in substantially parallel, spaced relationship in vertical planes within the precipitation chamber 6. Interdisposed in the spaces between the collecting electrode plates 22 are a plurality of discharge electrode subassemblies 32 which collectively form a discharge electrode assembly 30. Both the collecting electrode plates 22 and the discharge electrode subassemblies 32 are aligned parallel to and extend in the direction of the gas flow through the precipitation chamber 6 from the inlet 2 to the outlet 4 thereof.

Each collecting electrode plate 22 is suspended and supported from upper support beams 14 disposed across the precipitation chamber 6. The lower end of eah of the suspended electrode plates 22 is laterally constrained from movement by inserting it into a guide member 16 which is mounted to the lower support beams 18 disposed in the bottom of the precipitation chamber. Thus, the suspended collecting electrode plates, which may range anywhere from 12 to 50 feet in height, are free to move vertically downward within the guide members 16 due to temperature effects but are constrained from any lateral movement by guide members 16.

The collecting electrode plates 22 are shown in the drawing as being of a particular cross-section merely for purposes of illustration and not limitation. It is to be understood that the present invention contemplates utilizing collecting electrode plates of any of a number of cross-sectional design with the particular design utilized in any given situation being selected on an individual basis to give optimal precipitation efficiency and a quiescent zone at the surfaces of the collecting electrode plates 22.

The individual discharge electrode subassemblies 32 collectively and in conjunction with support bar 34 from which the individual discharge electrode subassemblies 32 are supported, form a discharge electrode assembly 30 which is suspended from the top of the precipitation chamber 6 and is mounted to the casing 12 through insulators 38. Each of the individual discharge electrode subassemblies 32 is formed of a plurality of individual discharge electrode members 36, commonly taut wires or rigid tubes, disposed at spaced intervals to extend transversely between and be mounted to an upper frame member and a lower frame member. Support bars 34 from which the individual discharge electrode assemblies 32 are supported extend transversely across the inlet and the outlet of the precipitation chamber 6 in the upper region of the housing 12 and are suspended by hanger rods 28 which pass coaxially through and are mounted by bolts 86 to the cover 40 of each of the insulators 38 mounted to the precipitator housing 12.

In operation, a particulate laden gas enters the precipitator housing 12 through the inlet 2 thereof and flows through the precipitation chamber 6 to the outlet 4 thereof. In traversing the precipitation chamber 6, the particulate laden gas flows between the spaced collecting electrode plate assemblies 20 and over the discharge electrode subassemblies 32 suspended therebetween. An electrical charge is applied to each of the discharge electrode subassemblies 32 so as to establish an electrostatic field extending between the discharge electrode subassembly and the grounded collecting electrode plates 22. As the particulates within the gas pass through the precipitation chamber 6, the particulates are ionized and migrate to and deposit upon the collecting electrode plates 22.

Figure 2:
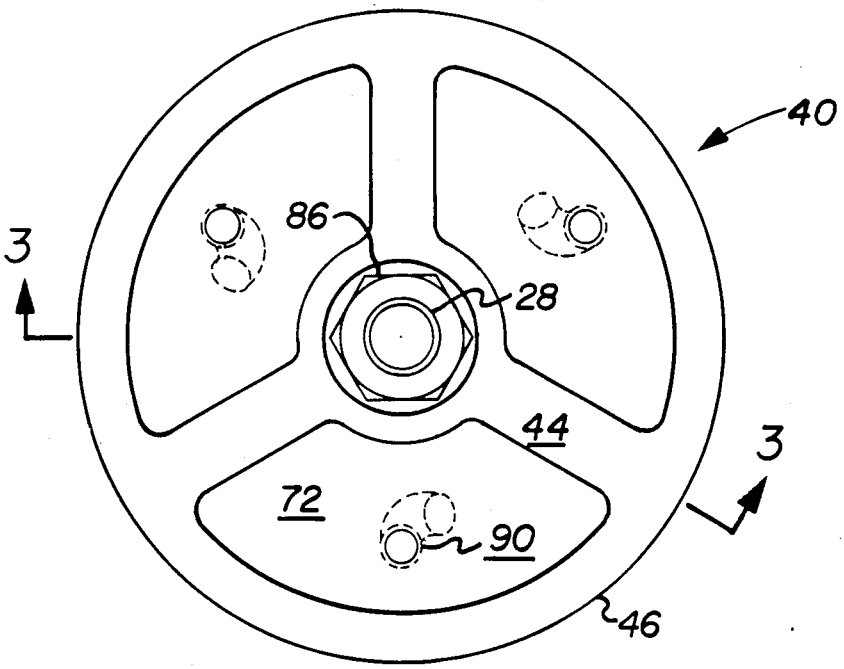
FIG. 2 is a top view looking down on the improved support insulator housing cap of the present invention.
Figure 3:
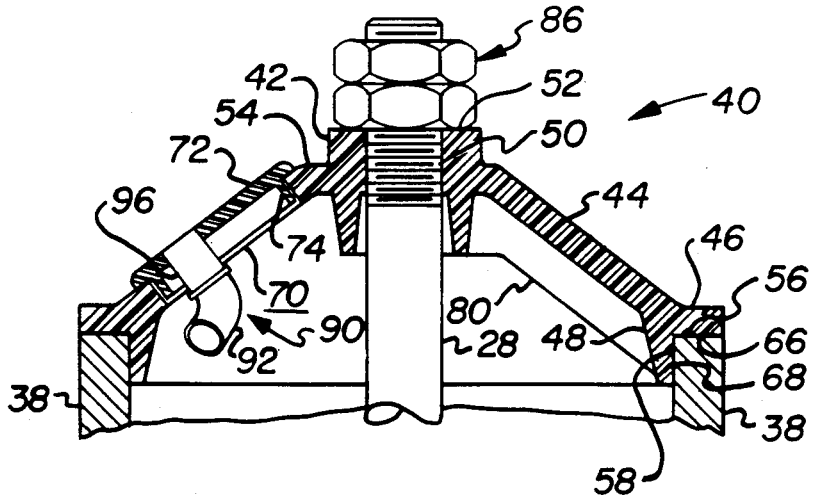
FIG. 3 is a sectional side elevational view of the improved support insulator housing cap of the present invention taken along line 3—3 of FIG. 2.

As best seen in FIGS. 2 and 3, the body of the cover cap 40 of the pesent invention comprises a top member 42, a sloping side wall 44, a radial lip 46 extending radially outwardly from the lower perimeter surface of the side wall 44, and an axial lip 48 extending axially outwardly from the lower perimeter surface of the side wall 44. The top 42 has a centrally located hole 50 formed therein which is adapted to receive the hanger rod 28, an upper surface 52 against which the hanger rod 28 may be mounted via hold down bolts 86, and a perimeter edge 54 from which the sloping side wall 44 of the body of the cover cap 40 extends coaxially outwardly and downwardly in the form of a frustrum of a cone, somewhat like a skirt, to terminate with a lower perimeter surface spaced below and outwardly from the perimeter edge 54 of the top member 42.

Extending outwardly from the lower perimeter surface of the sloping side wall 44 of the body of the cover cap 40 at substantially right angles to each other are a radial lip 46 and an axial lip 48. The radial lip 46 extends radially outwardly from the lower perimeter surface of the sloping wall 44 and has a lower surface 56 adapted to abut and close against the perimeter rim 66 of the insulator housing 38. The axial lip 48 extends axially outwardly from the lower perimeter surface of the sloping side wall 44 and has a peripheral surface 58 adapted to insert into the open end of the support insulator housing 38 and slip in mating relationship within the inner peripheral surface 68 of the end of the insulator housing 38.

At least one access opening 70 is provided in the sloping side wall 44 of the body of the cover cap 40 to provide access into the interior region of the cover cap 40 encompassed by the sloping side wall 44 and into the interior of the insulator housing 38. This access permits manual cleaning of the interior surfaces of insulator housing 38 and the cap cover 40 when and if necessary. Preferrably, three access openings 70 are provided at equal, circumferentially spaced intervals about the sloping side wall portion 44 of the body of the cover cap 40. Additionally, stiffening ribs 80 may be provided to extend outwardly on the inner surface of sloping side wall 44 intermediate the access openings 70 to enhance the structural integrity of the cover cap 40.

A removeable lid 72 is provided for each access opening 70 to seal each access opening when the lid 72 is in position covering the access opening. Preferrably, each lid 72 has an outwardly extending positioning rim 74 spaced radially inward from the perimeter of the lid. The positioning rim 74 is adapted to slip into the access opening 70 in mating relationship with the wall surrounding the opening so as to hold the lid in position over the access opening.

In order to maintain the interior of the cover cap 40 in a relatively clean condition and to limit build-up of particulate material from the flue gas in the interior of the support insulator housing 38, at least one gas injection means 90 is provided in association with the body of the cover cap 40 so as open through the sloping side wall portion 44 of the body of the cover cap 40 for passing a jet of scavenging gas into the interior region encompassed by the sloping side wall 44. The scavenging gas is injected at a gas pressure higher than that of the flue gas within the precipitator housing, whereby the scavenging gas will flow through the interior of the support insulator housing 38 into the precipitator housing thereby limiting the passage of the lower pressure flue gas into the insulator housing and carrying particulate matter from the insulator housing back into the precipitation chamber.

Preferrably, the gas injection means 90 comprises a tubular injection nozzle having an elbow subtending an angle of about 135 degrees. The base 96 of the tubular injection nozzle passes through the body of the cover cap 40 for connection to a supply of pressurized scavenging gas (not shown). The base 96 of the tubular injection nozzle 92 may be disposed in the sloping side portion 44 of the body of the cover cap 40 per se, or, as shown in the preferred embodiment illustrated in FIGS. 2 and 3, it may be disposed in the lid 72 covering the access opening 70 in the sloping side wall 44. In any case, the tubular injection nozzle 92 is orientated as to admit the scavenging gas substantially tangentially about the periphery of the interior region encompassed by the cap cover 40. By virtue of the 135 degree angle elbow in the tubular injection nozzle 92, the scavenging gas is also directed somewhat downwardly as well as tangentially such that a downwardly spiralling swirl of scavenging gas passes through the interior of the insulator housing 38 into the precipitation chamber.

Although the invention has been described and shown in relation to a frustoconical shaped sloping side wall with an annular top member, the invention has other embodiments which will be apparent to those skilled in the art in view of the foregoing disclosure. By way of example and not limitation, other embodiments of the cover cap may include a trapezoidal frustum sloping side wall portion with the top member having any number of sides which are compatible with the shape of the insulator housing. Thus, if the insulator housing is in the form of a multi-side shell rather than a cylindrical shell, the top member and the sloping side wall portion of the body of the cover cap may be shaped accordingly so as to be compatible with the insulator housing without departing from the spirit and scope of the invention as defined in the claims.

We claim:

1. A cover cap for a support insulator housing having a hanger rod passing coaxially therethrough for mounting to said cover cap, said cover cap comprising:

a. a top member having a perimeter edge, a centrally located hole passing therethrough for receiving the hanger rod, and an upper surface upon which the hanger rod is mounted;

b. a sloping side wall extending coaxially outwardly and downwardly from the perimeter edge of the top member to terminate with a lower perimeter surface spaced below and outward of the perimeter edge of the top member;

c. a radial lip extending outwardly from the lower perimeter surface of the sloping side wall and having a lower surface adapted to mate with the support insulator housing;

d. an axial lip extending axially downward from the lower perimeter surface of the sloping side wall, the axial lip adapted to insert into the support insulator housing;

e. means opening through the sloping side wall for passing a jet of scavenging gas into the interior region encompassed by the sloping side wall;

f. at least one access opening in the sloping side wall for providing access into the interior region encompassed by the sloping side wall; and g. removable lid means adapted for covering the access opening in the sloping side wall.

* * * * *